US012735971B2

(12) United States Patent
Shukor et al.

(10) Patent No.: US 12,735,971 B2
(45) **Date of Patent: *Sep. 15, 2026**

(54) DOWNHOLE FLUID SEPARATOR IN RE-ENTRY MULTILATERAL WELL

(71) Applicant: Halliburton Energy Services, Inc., Houston, TX (US)

(72) Inventors: Muhammad Arra'uf Abdul Shukor, Dhahran (SA); Micah Janzen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/812,640

(22) Filed: Aug. 22, 2024

(65) Prior Publication Data

US 2025/0067160 A1 Feb. 27, 2025

Related U.S. Application Data

(60) Provisional application No. 63/534,789, filed on Aug. 25, 2023.

(51) Int. Cl.
*E21B 43/38* (2006.01)
*E21B 41/00* (2006.01)
*E21B 47/07* (2012.01)

(52) U.S. Cl.
CPC ..... *E21B 43/38* (2013.01); *E21B 41/0035* (2013.01); *E21B 47/07* (2020.05)

(58) Field of Classification Search
CPC ..... E21B 41/0035; E21B 43/38
See application file for complete search history.

(56) References Cited

U.S. PATENT DOCUMENTS 2,452,920 A * 11/1948 Gilbert ..... E21B 43/305 166/50
5,711,374 A 1/1998 Kjos
(Continued)

FOREIGN PATENT DOCUMENTS

CN 206522127 U 9/2017
CN 110331973 A 10/2019
(Continued)

OTHER PUBLICATIONS

International Search Report and Written Opinion for International Patent Application No. PCT/US2024/043572 dated Dec. 4, 2024. PDF file. 11 pages.

*Primary Examiner* — Tara Schimpf
*Assistant Examiner* — Lamia Quaim
(74) *Attorney, Agent, or Firm* — Scott Richardson; C. Tumey Law Group PLLC

(57) ABSTRACT

A system may include an orienting liner hanger disposed in a main bore of a multilateral well in a position downhole from a junction of the multilateral well. The system may also include a lower completion secured to a downhole end of the orienting liner hanger and a fluid separator assembly disposed uphole from the orienting liner hanger. The fluid separator assembly may be configured to receive formation fluid, which may include oil and water, flowing uphole from the lower completion. The fluid separator assembly may be configured to at least partially separate the formation fluid into formation oil and formation water. The fluid separator assembly may be configured to output formation oil to an upper production tubing and output the formation water into a lateral bore of the multilateral well.

20 Claims, 5 Drawing Sheets

(56) References Cited

U.S. PATENT DOCUMENTS

| | | | | |
|---|---|---|---|---|
| 6,336,503 | B1 | 1/2002 | Alhanati et al. | |
| 6,547,003 | B1 | 4/2003 | Bangash et al. | |
| 6,923,259 | B2 | 8/2005 | Snow | |
| 10,583,373 | B2 | 3/2020 | Braaten et al. | |
| 11,913,322 | B1 * | 2/2024 | Aleid | E21B 41/0035 |
| 2001/0017207 | A1 | 8/2001 | Haheim | |
| 2002/0185275 | A1 | 12/2002 | Yang et al. | |
| 2010/0089569 | A1 | 4/2010 | Van Zuilekom et al. | |
| 2011/0079388 | A1 * | 4/2011 | Cox | E21B 43/38 166/266 |
| 2017/0022761 | A1 | 1/2017 | Joshi et al. | |
| 2017/0022797 | A1 | 1/2017 | Joshi et al. | |
| 2017/0268322 | A1 | 9/2017 | Culbertson et al. | |
| 2018/0154282 | A1 | 6/2018 | Braaten et al. | |
| 2021/0230980 | A1 | 7/2021 | Steele et al. | |
| 2022/0403726 | A1 | 12/2022 | Al-Qasim et al. | |
| 2023/0220759 | A1 | 7/2023 | Alrabaei et al. | |

FOREIGN PATENT DOCUMENTS

| | | | |
|---|---|---|---|
| CN | 113338875 | A | 9/2021 |
| WO | 9630625 | | 10/1996 |
| WO | 9837307 | A1 | 8/1998 |

* cited by examiner

DOWNHOLE FLUID SEPARATOR IN RE-ENTRY MULTILATERAL WELL

CROSS-REFERENCE TO RELATED APPLICATIONS

The present application is a non-provisional conversion of U.S. Provisional Application Ser. No. 63/534,789, filed Aug. 25, 2023, the entire disclosure of which is incorporated herein by reference.

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different production zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in re-drilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

These drawings illustrate certain aspects of some examples of the present disclosure and should not be used to limit or define the disclosure.

DETAILED DESCRIPTION

Figure 1:
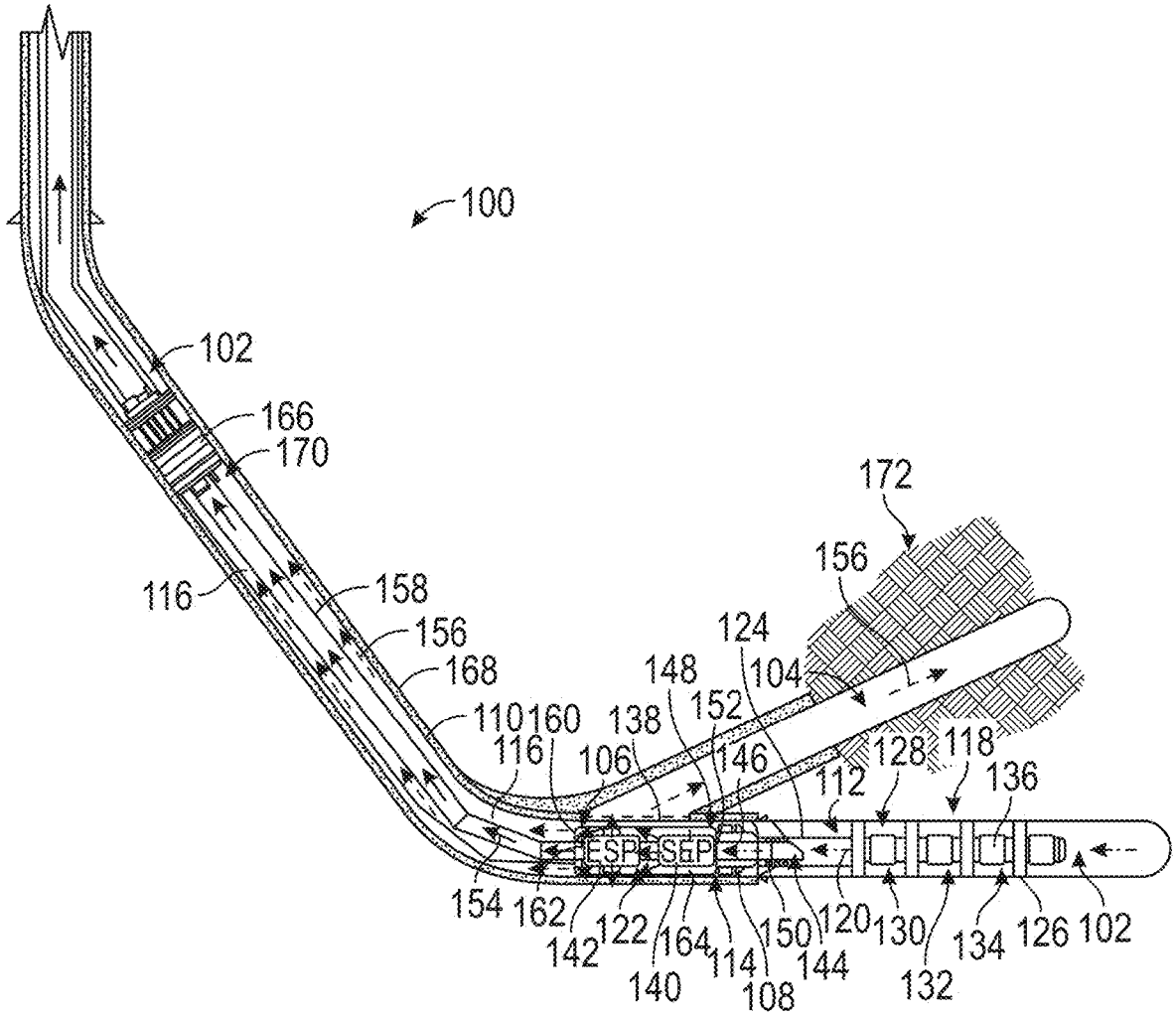
FIG. 1 illustrates a fluid separator assembly disposed within a junction of a multilateral well, in accordance with some embodiments of the present disclosure.

The present disclosure relates to the field of downhole fluid separator. More specifically, systems are described of multilateral well completion design to install fluid separator at the junction between the main bore and the lateral well on the upper completion and methods of use thereof. A fluid separator includes an oil/water separator and a gas/oil/water separator, for example. Fluid separators that are installed downhole in multilateral oil wells can require that they are placed in long tangent sections within a wellbore, above the multilateral junction. However, the cost associated with the planification and implementation of a novel multilateral well is significant. In fact, the cost to design and install a downhole fluid separator with a tangent section may be as high as the cost of the entire multilateral well without the separator. In addition, the placement of the fluid separator above the multilateral junction requires installing it right from the onset when completing the new well to minimize the risk of losing the well. In embodiments, the fluid separator may be installed inside the junction between the main bore and the lateral well. Further, the main bore uses an orientation liner hanger which provides depth and orientation control. The fluid separator may be installed in a horizontal configuration, for example. In embodiments, the fluid separator can be placed in the main bore at the junction between the main bore and the lateral well with a pump such as an electrical submersible pump disposed above the fluid separator. The multilateral junction may be placed above or inside the target formation. This configuration can be accomplished in a two-trip multilateral completion consisting of a lower completion with orientation liner hanger connected to additional lower completion, and an upper completion consisting of the fluid separator, an electrical submersible pump, and an upper packer. This simplifies the installation. This reduced complexity allows the fluid separator according to embodiments of the present disclosure to be installed into existing wells, i.e., retrofitting existing wells. Further, the lateral well can be a target formation. The existing wells do not require a tangent section at the junction for the placement of the fluid separator, significantly increasing the number of oil well candidates for installation of the fluid separator according to embodiments of the present disclosure.

The design of the installed completion equipment is critical for the downhole fluid separator to function as intended. Current well designs place the downhole fluid separator above the multilateral junction. By installing the fluid separator in the main bore at the junction between the main bore and the lateral well with a pump such as an electrical submersible pump disposed above the fluid separator according to embodiments of the present disclosure, an existing watered out well can be re-entered, and a new lateral added to it. This decreases the overall cost involved in installing the fluid separator according to embodiments of the present disclosure as compared with installing it at the completion of the well at the beginning of the life of the well. It also decreases the risks associated with installing downhole fluid separator according to embodiments of the present disclosure as existing wells that are already poor producers can be selected as candidates and represent a smaller cost if the well is lost during the trial as compared with selecting a potential well before well completion is finished. Using a fluid separator in a downhole setting combined with a multilateral junction provides efficiency gains. This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. The fluid separator according to embodiments of the present disclosure may be particularly useful in low flow rate wells (in the 200 barrel per day range or less), which tend to be shallow, and relatively inexpensive to drill. Moderate flow rate wells, for example 500-5000 barrels of fluid per day, can also be potential candidates for the downhole fluid separator according to embodiments of the present disclosure. Finally, it will also be useful for most multilaterals with very high flow rate wells, up to 50,000 barrels of fluid per day, for example.

Multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed. TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost-benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The junction includes a pump and a fluid separator. The pump includes any pump capable of drawing in fluid through the pump intake, pressurizing it, and lifting it to the surface such as an electrical submersible pump. The fluid separator and the pump can be above, at, or below the junction. The upper completion includes a retrievable electrical submersible pump packer while the lower completion has an orientation liner hanger.

FIG. 1 illustrates a fluid separator assembly disposed within a junction of a multilateral well, in accordance with some embodiments of the present disclosure. As illustrated, the multilateral well may include a Technology Advancement of Multilaterals (TAML) level 4 with re-entry packer allowing for the creation of a lateral well in existing wells or new wells. However, the multilateral well 100 may include any suitable type of multilateral well and completion. As illustrated, the multilateral well 100 may include a main bore 102 and at least one lateral bore 104. The lateral bore 104 may deviate from the main bore 102 at a junction 106. The junction 106 may include a portion of the main bore 102 from which the lateral bore 104 deviates from the main bore 102. As such, the junction 106 may be in direct fluid communication with the lateral bore 104 of the multilateral well 100.

Moreover, an orienting liner hanger 108 may be disposed in the main bore 102 of a multilateral well 100 in a position downhole from the junction 106. As illustrated, the orienting liner hanger 108 is secured to a portion of main bore casing 110 extending downhole from the junction 106. Further, the orienting liner hanger 108 may be sealed against the main bore casing 110 such that the orienting liner hanger 108 may fluidly isolate the junction 106 from a production portion 112 of the main bore 102. In particular, as set forth in greater detail below, the orienting liner hanger 108 may fluidly isolate a lower annulus end 114 of a separator annulus 116 from the production portion 112 of the main bore 102.

The orienting liner hanger 108 may also be configured to support a lower completion 118. The lower completion 118 may be secured to a downhole end of the orienting liner hanger 108. As illustrated, the lower completion 118 may extend into and through the production portion 112 of the main bore 102, which may produce formation fluid 120. The formation fluid 120 may include a combination of oil and water. Alternatively, the formation fluid 120 may include a combination of oil, gas, and water. The lower completion 118 may assist with directing and controlling flow of the formation fluid 120 from the production portion 112 of the main bore 102 toward the junction 106 of the multilateral well 100. Specifically, the lower completion 118 may direct to the formation fluid 120 to flow to a fluid separator assembly 122 disposed within a least a portion of the junction 106.

Moreover, the lower completion 118 may include a lower production tubing 124 and a plurality of production packers 126 disposed about the lower production tubing 124. The production packers 126 may be configured to isolate various production zones 128 (e.g., a first production zone 130, a second production zone 132, a third production zone 134, etc.) in the production portion 112 of the main bore 102. Further, the lower completion 118 may include at least one screen 136 disposed in each production zone (e.g., between adjacent packers of the plurality of production packers 126). The at least one screen 136 is configured to filter and/or clean formation fluid 120 flowing into the lower production tubing 124. Indeed, formation fluid 120 is configured to enter the lower production tubing 124 via the at least one screen 136 and flow uphole toward the fluid separator assembly 122. The fluid separator assembly 122 is configured to receive formation fluid 120 flowing uphole from the lower completion 118.

As set forth in greater detail below, the fluid separator assembly 122 may include an assembly housing 138, a fluid separator 140, and a pump 142. The fluid separator assembly 122 may also include an inlet feature 144 configured to seal against an inner surface of the orienting liner hanger 108. In particular, the inlet feature 144 may include an inlet tubular 146 configured to extend outward from an axially downhole end 148 of the fluid separator assembly 122. The inlet feature 144 may also include at least one seal 150 disposed about the inlet tubular 146. The inlet tubular 146 may be configured to extend into a portion of the orienting liner hanger 108 to form a seal between the inlet feature 144 and the inner surface of the orienting liner hanger 108. For example, with the inlet tubular 146 extended into the orienting liner hanger 108, the at least one seal 150 may compress between a radially outer surface of the inlet tubular 146 the inner surface of the orienting liner hanger 108 to form the seal.

The inlet feature 144 may be configured to fluidly connect the lower production tubing 124 with a fluid inlet 152 of the fluid separator 140 such that the formation fluid 120 may flow from the lower completion 118 into the fluid separator 140. The inlet feature 144 may also be configured to isolate the flow of formation fluid 120 from the lower completion 118 to the fluid separator assembly 122 from a separator annulus 116, which may improve performance of the fluid separator assembly 122.

As set forth above, the formation fluid 120 may include a combination of oil and water. After receiving the formation fluid 120 from the lower completion 118, the fluid separator assembly 122 is configured to at least partially separate the formation fluid 120 into formation oil 154 and formation water 156. In particular, the fluid separator 140 of the fluid separator assembly 122 is configured to at least partially separate the formation fluid 120 into the formation oil 154 and the formation water 156. Moreover, as set forth in greater detail below, the fluid separator assembly 122 is configured to output the formation oil 154 to an upper production tubing 158 and output the formation water 156 into the lateral bore 104 of the multilateral well 100.

As illustrated, the fluid separator assembly 122 may be disposed at least partially within the junction 106 of the multilateral well 100 and uphole from the orienting liner hanger 108. As illustrated, the an upper separator end 160 of the fluid separator assembly 122 may extend uphole from an upper junction end 162 of the junction 106, and the axially downhole end 148 of the fluid separator assembly 122 may extend downhole from a lower annulus end 114 of the junction 106. However, the fluid separator assembly 122 may alternatively be disposed entirely within the junction 106.

Moreover, an upper completion packer 166 may be secured within the main bore 102 in a position uphole from the fluid separator assembly 122. As illustrated, the upper production tubing 158 extends from the fluid separator assembly 122 to the upper completion packer 166. Further, a second upper production tubing 158 may extend from the upper completion packer 166 toward the surface. The upper completion packer 166 may include an upper pump 142 to drive the formation oil 154 output from the fluid separator 140 in the uphole direction through the upper production tubing 158, the upper completion packer 166, and the second upper production tubing 158 toward the surface.

Additionally, the upper completion packer 166 is configured to seal the separator annulus 116 from the surface. As illustrated, the separator annulus 116 may be formed in the main bore 102 between the main bore casing 110 and radially outer surfaces of the fluid separator assembly 122 and the upper production tubing 158. Alternatively, the separator annulus 116 may be formed between a wellbore wall 168 of the main bore 102 and the radially outer surfaces of the fluid separator assembly 122 and the upper production tubing 158 for multilateral wells 100 without main bore casing 110. Moreover, the upper completion packer 166 is configured to seal an upper annulus end 170 of the separator annulus 116 and, as set forth above, the orienting liner hanger 108 is configured to seal the lower annulus end 114 of the separator annulus 116. Indeed, formation water 156 output into the separator annulus 116, via the fluid separator assembly 122, may be sealed from flowing downhole into the production portion 112 of the main bore 102, uphole toward the surface, or back into the fluid separator assembly 122. As such, the formation water 156 flowing into the separator annulus 116, via the fluid separator assembly 122 may be directed to flow into the lateral bore 104, which is in fluid communication with the separator annulus 116, such that the formation water 156 may flow back into a subterranean formation 172. Directing the formation water 156 back into the subterranean formation 172 via the lateral bore 104 may eliminate the need to pump the formation water 156 to the surface for transportation and storage, which may improve efficiency and reduce the cost of completion operations.

Figure 2:
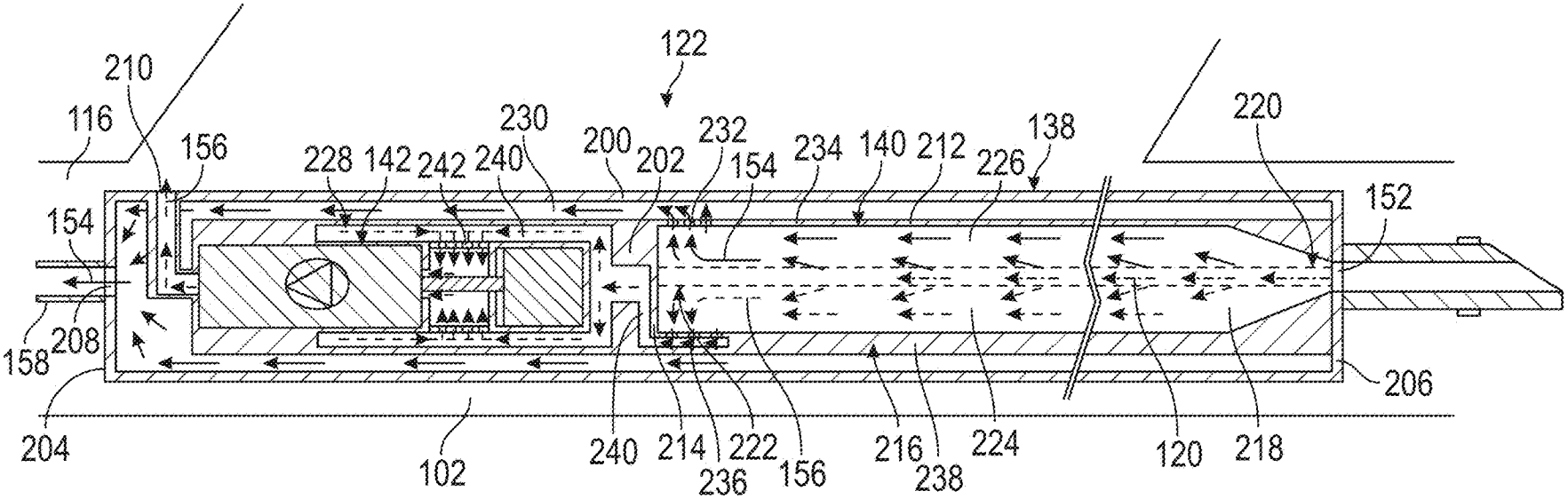
FIG. 2 illustrates a cross-sectional view of a fluid separator assembly, in accordance with some embodiments of the present disclosure.

FIG. 2 illustrates a cross-sectional view of a fluid separator assembly, in accordance with some embodiments of the present disclosure. As set forth above, the fluid separator assembly 122 may include the assembly housing 138, the fluid separator 140, and the pump 142. As illustrated, the fluid separator 140 may be disposed within the assembly housing 138. The assembly housing 138 may include an outer tubular 200 and an inner frame 202 disposed within the outer tubular 200. The assembly housing 138 may further include an upper end wall 204 and a lower end wall 206 configured to enclose the inner frame 202 within the outer tubular 200. Indeed, the outer tubular 200, the lower end wall 206, and the upper end wall 204 may be configured to fluidly isolate an interior of the assembly housing 138 from the separator annulus 116, such that fluid (e.g., formation fluid 120, formation water 156, formation oil 154, etc.) may only flow into the assembly housing 138 via the fluid inlet 152 formed in the lower end wall 206 and flow out of the assembly housing 138 via a housing oil outlet 208 and a housing water outlet 210, as set forth in greater detail below.

The inner frame 202 may include any suitable shape for housing the fluid separator 140 and the pump 142 within the outer tubular 200. For example, as illustrated, a downhole portion of the inner frame 202 may include an elongated tubular 212 having a downhole end secured to the lower end wall 206 and an uphole end closed with an upper separator wall 214. The elongated tubular 212 may form a separator housing 216 for the fluid separator 140, and an elongated fluid chamber 218 may be formed within the separator housing 216. Further, a downhole end of the separator housing 216 may include the lower end wall 206 of the assembly housing 138 such that the fluid inlet 152 formed in the lower end wall 206 may be in fluid communication with the elongated fluid chamber 218. As such, the fluid separator 140 may be configured to receive the formation fluid 120 from the lower completion 118 (shown in FIG. 1) through the fluid inlet 152. In particular, the formation fluid 120 may flow into a downhole end 220 of the elongated fluid chamber 218 via the fluid inlet 152. The formation fluid 120 may continue to flow through the elongated fluid chamber 218 from the downhole end 220 toward an uphole end 222 of the elongated fluid chamber 218. The elongated fluid chamber 218 may include any suitable length.

As the formation fluid 120 flows through the elongated fluid chamber 218, the formation fluid 120 may gradually separate into the formation oil 154 and the formation water 156 in response to gravitational forces. The formation water 156 may have a higher density than the formation oil 154. Further, oil and water are immiscible. Accordingly, the formation oil 154 and the formation water 156 may separate due to gravitational forces as the formation fluid 120 flows through the elongated fluid chamber 218. As illustrated, the formation water 156 may fall toward a bottom portion 224 of the elongated fluid chamber 218 since the formation water 156 has a higher density than the formation oil 154. For the same reasons, the formation oil 154 may rise toward a top portion 226 of the elongated fluid chamber 218. Ideally, the oil and the water from the formation fluid 120 are completely separated upon reaching the downhole end 220 of the elongated fluid chamber 218. However, in some cases, the oil and the water may not completely separate. As such, the term formation oil 154 may refer to a combination of oil and water having at least 70% oil. Further, the term formation water 156 may refer to a combination of water and oil having at least 70% water. However, the fluid separator 140 may include any suitable separator assembly configured to separate the formation fluid 120 into formation water 156 and formation oil 154.

Moreover, the inner frame 202 (e.g., the separator housing 216, a pump housing 228, etc.) may be radially offset from an inner surface of the outer tubular 200 such that a gap (e.g., oil flow path 230) is formed between the inner frame 202 and the outer tubular 200. Further, an oil outlet 232 may be formed in a top portion 234 of the separator housing 216. In particular, the oil outlet 232 may be formed in a top surface of the elongated fluid chamber 218 in a position proximate to the uphole end 222 of the elongated fluid chamber 218. The fluid separator 140 may be positioned and oriented within the main bore 102 such that the top portion 234 of the separator housing 216 is oriented with respect to gravity. Further, the separator housing 216 may be disposed within a horizontal portion of the main bore 102. Moreover, the oil outlet 232 is in fluid communication with the elongated fluid chamber 218 such that the formation oil 154 may flow into the oil outlet 232 from the elongated fluid chamber 218 after separating from the formation water 156. Further, as illustrated, the oil outlet 232 may be configured to output the formation oil 154 from separator housing 216 into the oil flow path 230 formed between the inner frame 202 and the outer tubular 200. As illustrated, the formation oil 154 may be configured to flow through the oil flow path 230 in the uphole direction toward the housing oil outlet 208. The housing oil outlet 208 may in direct fluid communication with the oil flow path 230 such that the formation oil 154 may flow to the housing oil outlet 208 and into the upper production tubing 158 via the oil flow path 230.

Moreover, a water outlet 236 may be formed in a bottom portion 238 of the separator housing 216. In particular, the water outlet 236 may be formed in a bottom surface of the elongated fluid chamber 218 in a position proximate to the uphole end 222 of the elongated fluid chamber 218. The water outlet 236 is in fluid communication with the elongated fluid chamber 218 such that the formation water 156 may flow into the water outlet 236 from the elongated fluid chamber 218 after separating from the formation oil 154. Further, as illustrated, the water outlet 236 may be configured to output the formation water 156 such that the formation water 156 may flow into the pump 142. Indeed, a fluid conduit 240 may extend through the inner frame between the water outlet 236 of the fluid separator 140 and a pump inlet 242 of the pump 142 such that the formation water 156 output from the fluid separator 140 may flow directly into the pump 142.

Figure 3:
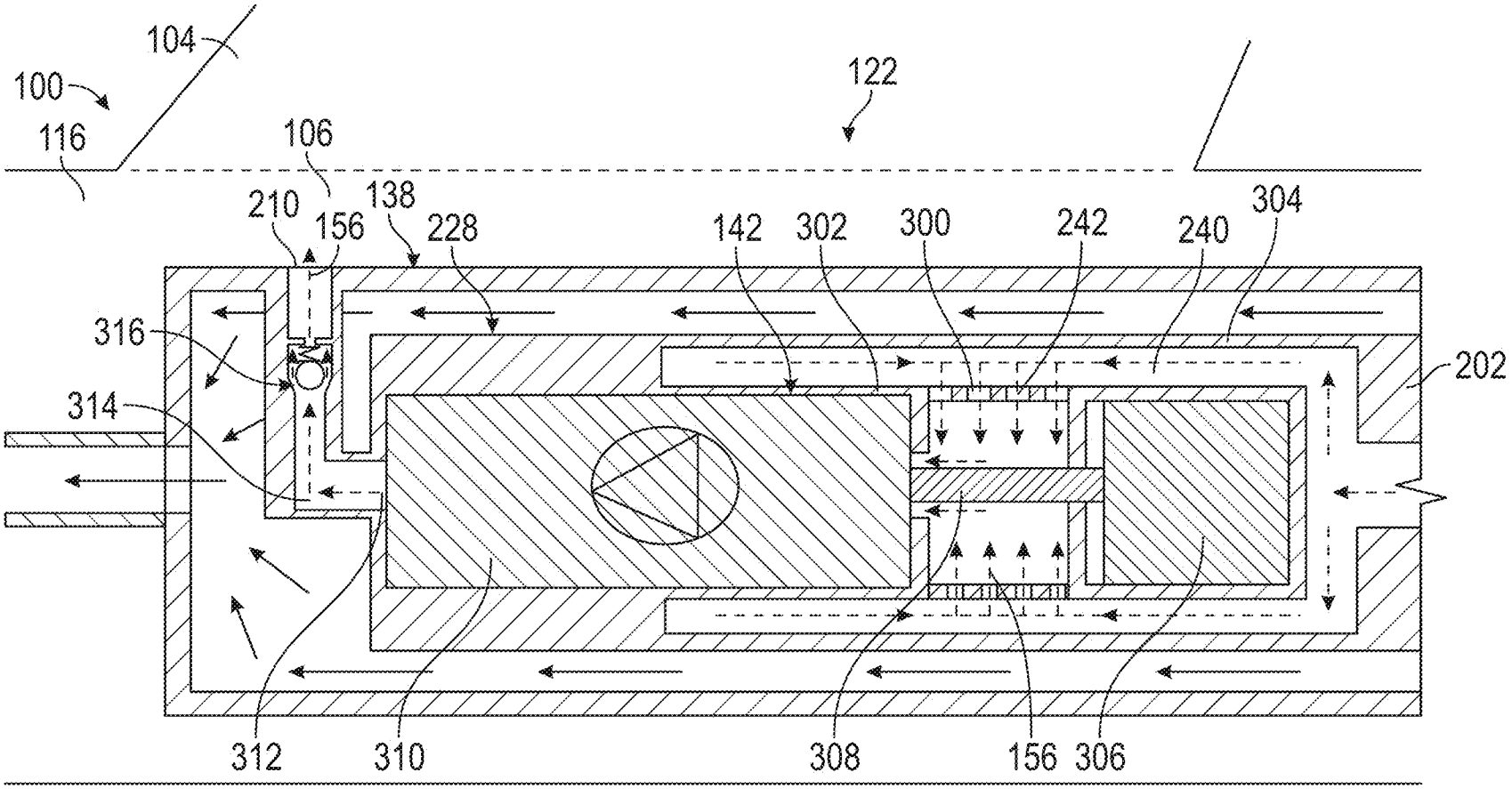
FIG. 3 illustrates a cross-sectional view of a pump portion of a fluid separator assembly, in accordance with some embodiments of the present disclosure.

FIG. 3 illustrates a cross-sectional view of a pump portion of a fluid separator assembly, in accordance with some embodiments of the present disclosure. As set forth above, the fluid separator assembly 122 may include the fluid conduit 240 extending through the inner frame 202 between the water outlet 236 of the fluid separator 140 (shown in FIG. 2) and the pump inlet 242 of the pump 142. The pump inlet 242 may include a plurality of holes 300 formed in a radially outer surface of an inner housing portion 302 of the pump housing 228. Alternatively, the pump inlet 242 may include a single hole, channel, or passage extending into the inner housing portion 302. As illustrated, the inner frame 202 may include the pump housing 228 having an outer housing portion 304 and the inner housing portion 302 disposed within the outer housing portion 304. Further, the pump housing 228 may have a substantially tubular shape with the outer housing portion 304 forming a radially outer surface of the pump housing 228. Additionally, respective downhole sections of the outer housing portion 304 and the inner housing portion 302 may be radially offset to form at least a portion of the fluid conduit 240 extending through the inner frame 202. That is, there may be a gap between a radially inner surface of the outer housing portion 304 and a radially outer surface of the inner housing portion 302 to form a portion of the fluid conduit 240.

Moreover, the pump 142 may include a retrievable electrical submersible pump. However, the pump 142 may include any suitable pump 142 configured to receive the formation water 156 from the fluid separator 140 and pump the formation water 156 toward the lateral bore 104. As illustrated, the pump 142 may include a motor 306, a drive shaft 308, and a main pump portion 310, each disposed within the inner housing portion 302 of the pump housing 228. Indeed, the pump 142 may be disposed within the assembly housing 138 in a position uphole from the fluid separator 140 (shown in FIG. 2). Moreover, the motor 306 may be configured to actuate the drive shaft 308. Further, the drive shaft 308 may be configured drive the main pump portion 310 such that the main pump portion 310 may pull the formation water 156 flowing through the fluid conduit 240 from the fluid separator 140 and drive the formation water 156 out of a pump outlet 312 toward the lateral bore 104.

In particular, the assembly housing 138 may include a water outlet line 314 extending from the pump outlet 312 to the housing water outlet 210 formed in a radially outer surface of the assembly housing 138. The pump 142 may be configured to drive the formation water 156 through the water outlet line 314 such that the formation water 156 flows out of the assembly housing 138 via the housing water outlet 210. As set forth above, the assembly housing 138 may be positioned within the multilateral well 100 such that the formation water 156 is output into the separator annulus 116. That is, the assembly housing 138 may be positioned within the multilateral well 100 to position the housing water outlet 210 within the junction 106 of the multilateral well 100. Alternatively, the assembly housing 138 may be positioned within the multilateral well 100 such that the formation water 156 is output directly into the lateral bore 104.

Moreover, the fluid separator assembly 122 may further include a one way check valve 316 disposed within the water outlet line 314. The one way check valve 316 is configured to prevent the formation water 156 from flowing back into the fluid separator assembly 122 from the separator annulus 116 and/or the lateral bore 104. Specifically, the one way check valve 316 is configured to block fluid from flowing through the water outlet line 314 in the direction from the housing water outlet 210 toward the pump 142. As illustrated, the one way check valve 316 may include a ball check valve. However, the one way check valve 316 may include any suitable type of one way check valve 316 for blocking fluid from flowing through the water outlet line 314 in the direction from the housing water outlet 210 toward the pump 142. For example, the one way check valve 316 may alternatively include a diaphragm check valve, a swing check valve, a lift check valve, etc.

Figure 4:
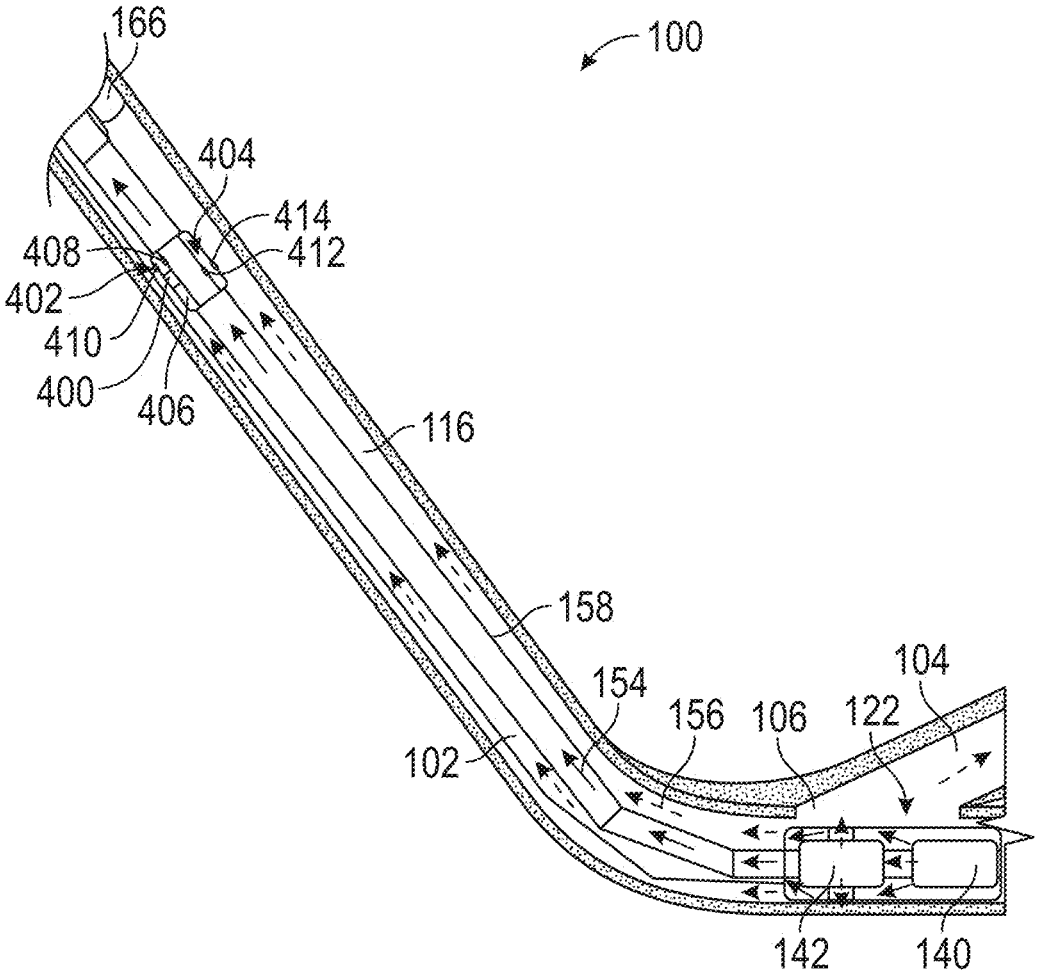
FIG. 4 illustrates at least one gauge sensor disposed in a main bore of a multilateral well between a fluid separator assembly and an upper completion packer, in accordance with some embodiments of the present disclosure.

FIG. 4 illustrates at least one gauge sensor disposed in a main bore of a multilateral well between a fluid separator assembly and an upper completion packer, in accordance with some embodiments of the present disclosure. As illustrated, the multilateral well 100 may include a Technology Advancement of Multilaterals (TAML) level 4 with re-entry packer allowing for the creation of a lateral well in existing wells or new wells. However, the multilateral well 100 may include any suitable type of multilateral well 100 and completion having the lateral bore 104 deviate from the main bore 102 at the junction 106.

As set forth above, the fluid separator assembly 122 may be disposed at least partially within the junction 106 of the multilateral well 100 and uphole from the orienting liner hanger 108 (shown in FIG. 1). Further, formation fluid 120 may flow into the fluid separator assembly 122 from the lower completion 118 anchored to the orienting liner hanger 108 (shown in FIG. 1). The fluid separator assembly 122 is configured to separate the formation fluid 120 into the formation oil 154 and the formation water 156. The fluid separator assembly 122 is configured to output the formation oil 154 into the upper production tubing 158 such that the formation oil 154 may flow toward the surface. The upper production tubing 158 may extend at least to the upper completion packer 166. Moreover, the fluid separator assembly 122 is configured to output the formation water 156 into the separator annulus 116 and/or the lateral bore 104.

Further, a controller 400, at least one pressure sensor 402, at least one temperature sensor 404, or some combination thereof, may be positioned between the orienting liner hanger 108 and an upper completion packer 166 in the main bore 102. As illustrated, a downhole sensor tool 406 may be disposed along a portion of the upper production tubing 158. However, the controller 400, the at least one pressure sensor 402, and the at least one temperature sensor 404 may be disposed in any suitable portion of the multilateral well 100 between the orienting liner hanger 108 and the upper completion packer 166.

Moreover, the downhole sensor tool 406 may include a first pressure sensor 408 to measure fluid pressure of the formation oil 154 flowing through the upper production tubing 158. Additionally, or alternatively, the downhole sensor tool 406 may include a second pressure sensor 410 to measure the fluid pressure in the separator annulus 116 about the downhole sensor tool 406. The controller 400 may be configured to receive the pressure measurements from the first pressure sensor 408 and/or the second pressure sensor 410 to determine the effectiveness of the fluid separator 140. Further, the controller 400 may be configured to output instructions to the pump 142 to control a flow rate of the pump 142 based at least in part on the determined effectiveness of the fluid separator 140. For example, the controller 400 may be configured to output instructions to the pump 142 to reduce the flow rate in response to inadequate separation of the formation fluid 120 into the formation water 156 and the formation oil 154.

Additionally, the downhole sensor tool 406 may include a first temperature sensor 412 to measure temperature of the formation oil 154 flowing through the upper production tubing 158. Additionally, or alternatively, the downhole sensor tool 406 may include a second temperature sensor 414 to measure the temperature in the separator annulus 116 about the downhole sensor tool 406. The controller 400 may be configured to receive the temperature measurements from the first temperature sensor 412 and/or the second temperature sensor 414 to determine the effectiveness of the fluid separator 140. Further, the controller 400 may be configured to output instructions to the pump 142 to control a flow rate of the pump 142 based at least in part on the determined effectiveness of the fluid separator 140. Indeed, as set forth above, the controller 400 may be configured to output instructions to the pump 142 to reduce the flow rate in response to inadequate separation of the formation fluid 120 into the formation water 156 and the formation oil 154. Moreover, the controller 400 may be configured to determine the effectiveness of the fluid separator 140 based on a combination of the temperature measurements and the pressure measurements.

Figure 5:
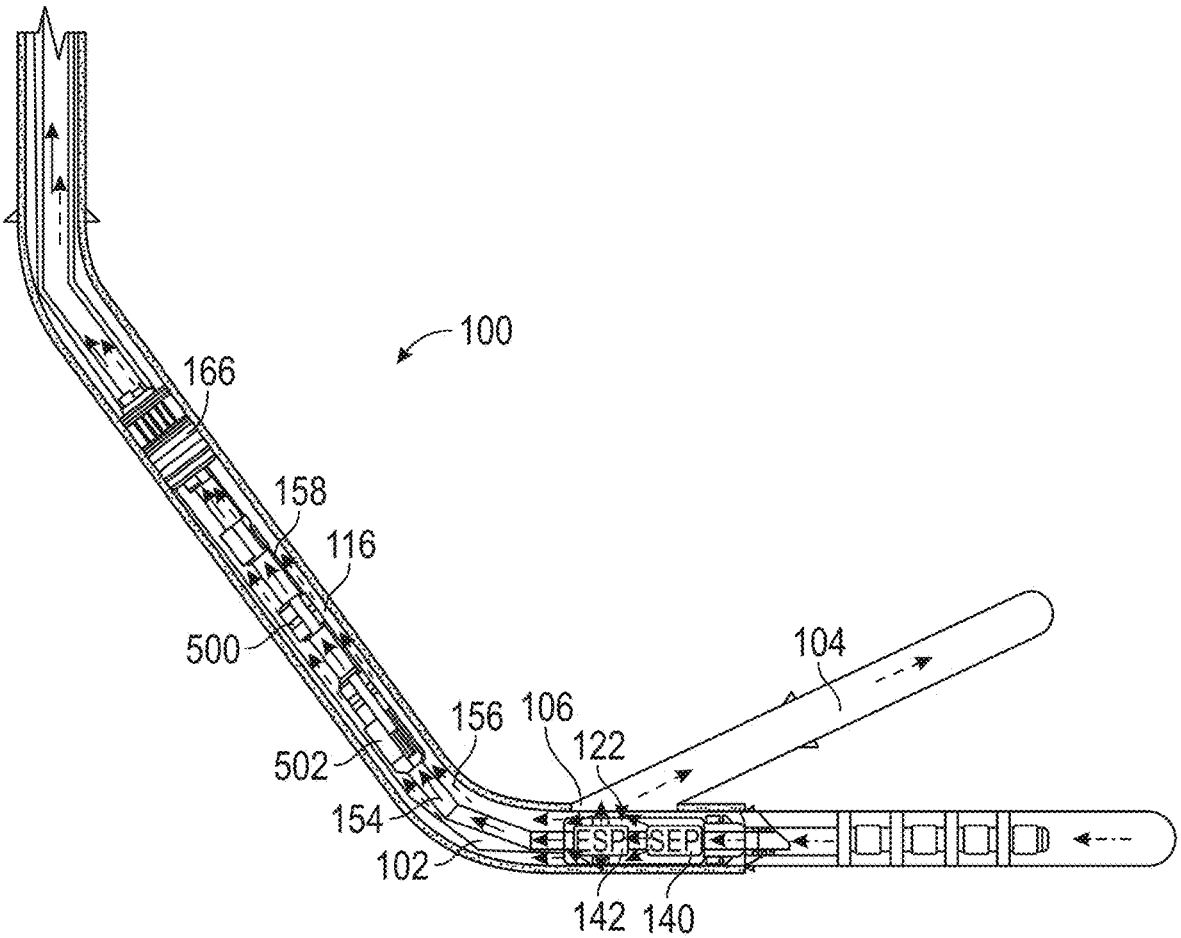
FIG. 5 illustrates an upper inflow control valve and a lower inflow control valve disposed in a main bore of a multilateral well between a fluid separator assembly and an upper completion packer for sampling formation water, in accordance with some embodiments of the present disclosure.

FIG. 5 illustrates an upper inflow control valve and a lower inflow control valve disposed in a main bore of a multilateral well between a fluid separator assembly and an upper completion packer for sampling formation water, in accordance with some embodiments of the present disclosure. As illustrated, the multilateral well 100 may include a Technology Advancement of Multilaterals (TAML) level 4 with re-entry packer allowing for the creation of a lateral well in existing wells or new wells. However, the multilateral well 100 may include any suitable type of multilateral well 100 and completion having the lateral bore 104 deviate from the main bore 102 at the junction 106.

As illustrated an upper inflow control valve 500 and a lower inflow control valve 502 may be disposed between the fluid separator assembly 122 and the upper completion packer 166. The upper inflow control valve 500 and the lower inflow control valve 502 may be any valve operated automatically (autonomous inflow control valve), manually, or remotely as part of an intelligent completion. For example, as illustrated, the lower inflow control valve 502 may include shrouded inflow control valves with a retrievable tubing plug.

During operation, it may be desirable to take samples of the formation water 156 output via the fluid separator assembly 122 to determine the effectiveness of the fluid separator 140. Based at least in part on the determined effectiveness of the fluid separator 140, a surface controller may be configured to output instructions to the pump 142 to adjust a flow rate of the pump 142. To sample the formation water 156, the lower inflow control valve 502 may be configured to selectively block flow of formation oil 154 through the upper production tubing 158. That is, the lower inflow control valve 502 may be configured to close, which may block flow of formation oil 154 through the upper production tubing 158 at the lower inflow control valve 502.

As illustrated, the upper inflow control valve 500 may be disposed between the lower inflow control valve 502 and the upper completion packer 166. In response to the lower inflow control valve 502 blocking flow of the formation oil 154 through the upper production tubing 158, the upper inflow control valve 500 may be configured to open, which opens a flow path from the separator annulus 116 to a portion of the upper production tubing 158 uphole from the lower inflow control valve 502. As such, the formation water 156 may begin to flow through the upper production tubing 158 toward the surface. Over time, the formation oil 154 in the upper production tubing from before the lower inflow control valve 502 was closed may finish flowing to the surface such that only formation water 156 may remain in the upper production tubing 158 above the lower inflow control valve 502. Accordingly, samples of the formation water 156 may be taken at the surface. Such samples may provide an indication of the percentage of water and percentage of oil in the formation water 156 that is being output into the separator annulus 116 and lateral bore 104 via the fluid separator 140. The effectiveness of the fluid separator 140 may be determined based at least in part on the percentage of water and percentage of oil in the formation water 156.

Moreover, the inflow control valves 500, 502 may be used to control multiple zones selectively, reduce water and gas cuts, and maximize oil productivity. The addition of the upper inflow control valve 500 and the shrouded interval control valve with retrievable tubing plug (e.g., the lower inflow control valve 502) may allow for control of the flow of the formation water 156 injection into the separator annulus 116 and control of production formation oil 154 from the fluid separator 140 via a micro-annulus of the lower inflow control valve 502. Indeed, the interval control valves may help to improve oil production, as well as allow for sampling of the formation water 156 if needed.

Accordingly, the present disclosure may provide a fluid separator assembly as well as various other components for separating formation fluid into formation oil that is output to the surface and formation water that is output into a lateral bore of the multilateral well. Methods and systems may include any of the various features disclosed herein, including one or more of the following statements.

Statement 1. A system comprising: an orienting liner hanger disposed in a main bore of a multilateral well in a position downhole from a junction of the multilateral well; a lower completion secured to a downhole end of the orienting liner hanger; and a fluid separator assembly disposed uphole from the orienting liner hanger, wherein the fluid separator assembly is configured to receive formation fluid flowing uphole from the lower completion, wherein the formation fluid includes oil and water, wherein the fluid separator assembly is configured to at least partially separate the formation fluid into formation oil and formation water, wherein the fluid separator assembly is configured to output formation oil to an upper production tubing, and wherein the fluid separator assembly is configured to output the formation water into a lateral bore of the multilateral well.

Statement 2. The system of statement 1, wherein the fluid separator assembly is disposed at least partially within the junction of the multilateral well, wherein the junction includes a portion of the main bore in direct fluid communication with a lateral bore of the multilateral well.

Statement 3. The system of statement 1 or statement 2, further comprising an upper completion packer secured within the main bore in a position uphole from the fluid separator assembly, wherein the upper production tubing extends from the fluid separator assembly to the upper completion packer, wherein a junction annulus is formed in the main bore between a wellbore wall of the main bore and radially outer surfaces of the fluid separator assembly and the upper production tubing, and wherein the upper completion packer is configured to seal an upper end of the junction annulus.

Statement 4. The system of any preceding statement, wherein the orienting liner hanger is configured to seal a lower end of the junction annulus, wherein the fluid separator assembly is configured to output the formation water into the junction annulus, and wherein the junction annulus is in fluid communication with the lateral bore such that the formation water is configured to flow into the lateral bore via the junction annulus.

Statement 5. The system of any preceding statement, wherein the fluid separator assembly includes an inlet feature configured to seal against an inner surface of the of the orienting liner hanger, wherein the inlet feature extends outward from an axially downhole end of the separator assembly, wherein the inlet feature includes a tubular and at least one seal disposed about the tubular, and wherein the seals are configured to seal the tubular against an inner surface of the of the orienting liner hanger with the tubular disposed in the orienting liner hanger.

Statement 6. The system of any preceding statement, wherein the lower completion includes: a lower production tubing, at least one production packer configured to isolate production zones along the lower production tubing, and at least one screen disposed in each production zone, and wherein formation fluid is configured to enter the lower production tubing via the at least one screen and flow uphole toward the fluid separator assembly.

Statement 7. The system of any preceding statement, wherein the fluid separator assembly comprises: an assembly housing; a fluid separator disposed within the assembly housing, wherein the fluid separator is configured to at least partially separate oil of the formation fluid from water of the formation fluid to at least partially separate the formation fluid into the formation oil and the formation water; and a pump disposed within the assembly housing in a position uphole from the fluid separator, wherein the pump is configured to drive the formation water into a lateral wellbore.

Statement 8. The system of any preceding statement, wherein the pump comprises a retrievable electrical submersible pump.

Statement 9. The system of any preceding statement, wherein the fluid separator includes an elongated tubular disposed within the assembly housing, wherein the elongated tubular includes at least one oil outlet formed in a top portion of the elongated tubular proximate an upper end of the elongated tubular, wherein the elongated tubular includes at least one water outlet formed in a bottom portion of the elongated tubular proximate the upper end of the elongated tubular, and wherein gravity is configured to separate the oil from the water based on density as the formation fluid flows in an uphole direction through the elongated tubular toward the oil outlet and the water outlet.

Statement 10. The system of any preceding statement, wherein the fluid separator assembly further comprises a fluid conduit extending from the at least one water outlet to a pump inlet of the pump, and wherein a water outlet line extends from a pump outlet of the pump to a housing water outlet formed in a radially outer surface of the assembly housing, and wherein the formation water is configured to flow toward the lateral bore via the housing water outlet.

Statement 11. The system of any preceding statement, wherein the housing water outlet is disposed within the junction of the multilateral well.

Statement 12. The system of any preceding statement, wherein the fluid separator assembly includes a one way check valve disposed within the water outlet line, wherein the one way check valve is configured to prevent formation water from flowing into the fluid separator assembly from the junction annulus and/or the lateral bore.

Statement 13. The system of any preceding statement, wherein the fluid separator assembly further comprises an oil flow path extending from the at least one oil outlet to a housing oil outlet formed in an upper end of the assembly housing, and wherein the formation oil is configured to flow into the upper production tubing via the housing oil outlet.

Statement 14. The system of any preceding statement, further comprising a controller and at least one pressure and/or temperature sensor positioned between the orienting liner hanger and an upper completion packer in the main bore, wherein the controller is configured to receive pressure and/or temperature measurements from the at least one pressure and/or temperature sensor, and wherein the controller is configured to output instructions to control a flow rate of a pump of the fluid separator assembly based at least in part on the pressure and/or temperature measurements.

Statement 15. The system of any preceding statement, further comprising an upper inflow control valve and a lower inflow control valve disposed between the fluid separator assembly and an upper completion packer, wherein the lower inflow control valve is configured to selectively block flow of formation oil through the upper production tubing, wherein the upper inflow control valve is disposed between the lower inflow control valve and the upper completion packer, and wherein the upper inflow control valve is configured to open a flow path from the junction annulus to the upper production tubing in response to the lower inflow control valve blocking flow of the formation oil through the upper production tubing such that the formation water may flow to the surface via the upper production tubing for sampling.

Statement 16. A system comprising: an orienting liner hanger disposed in a main bore of a multilateral well in a position downhole from a junction of the multilateral well; a lower completion secured to a downhole end of the orienting liner hanger; a fluid separator assembly disposed at least partially within the junction of the multilateral well and uphole from the orienting liner hanger, wherein the fluid separator assembly is configured to receive formation fluid flowing uphole from the lower completion, wherein the formation fluid includes oil and water, wherein the fluid separator assembly is configured to at least partially separate the formation fluid into formation oil and formation water, wherein the fluid separator assembly is configured to output formation oil to an upper production tubing, and wherein the fluid separator assembly is configured to output the formation water into a lateral bore of the multilateral well; and an upper completion packer secured within the main bore in a position uphole from the fluid separator assembly, wherein the upper production tubing extends from the fluid separator assembly to the upper completion packer, wherein a junction annulus is formed in the main bore between a wellbore wall of the main bore and radially outer surfaces of the fluid separator assembly and the upper production tubing, wherein the junction annulus is in fluid communication with the lateral bore, and wherein the upper completion packer is configured to seal an upper end of the junction annulus and the orienting liner hanger is configured to seal a lower end of the junction annulus such that formation water output into the junction annulus, via the fluid separator assembly, is directed to flow into the lateral bore from the junction annulus.

Statement 17. A method, comprising: drawing a formation fluid into a fluid separator assembly, wherein the fluid separator assembly is located at a junction of a multilateral well; separating formation oil from formation water via the fluid separator assembly; drawing formation oil up hole to a surface; and injecting formation water from the fluid separator assembly into a lateral bore of the multilateral well.

Statement 18. The method of statement 17, further comprising the step of cleaning the formation water before injecting the formation water into the lateral bore.

Statement 19. The method of statement 17 or statement 18, further comprising the step of measuring a pressure of the formation water in an annulus of a main bore of the multilateral well in between the fluid separator assembly and an upper completion packer.

Statement 20. The method of any of statements 17-19, further comprising the step of measuring temperature of the formation water in an annulus of a main bore of the multilateral well in between the fluid separator assembly and an upper completion packer.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The systems and methods may comprise any of the various features disclosed herein, comprising one or more of the following statements.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system comprising:

an orienting liner hanger disposed in a main bore of a multilateral well in a position downhole from a junction of the multilateral well;

a lower completion secured to a downhole end of the orienting liner hanger; and a fluid separator assembly disposed uphole from the orienting liner hanger, wherein the fluid separator assembly is configured to receive formation fluid flowing uphole from the lower completion, wherein the formation fluid includes oil and water, wherein the fluid separator assembly is configured to at least partially separate the formation fluid into formation oil and formation water, wherein the fluid separator assembly is configured to output formation oil to an upper production tubing, and wherein the fluid separator assembly is configured to output the formation water into a lateral bore of the multilateral well.

2. The system of claim 1, wherein the fluid separator assembly is disposed at least partially within the junction of the multilateral well, wherein the junction includes a portion of the main bore in direct fluid communication with a lateral bore of the multilateral well.

3. The system of claim 1, further comprising an upper completion packer secured within the main bore in a position uphole from the fluid separator assembly, wherein the upper production tubing extends from the fluid separator assembly to the upper completion packer, wherein a junction annulus is formed in the main bore between a wellbore wall of the main bore and radially outer surfaces of the fluid separator assembly and the upper production tubing, and wherein the upper completion packer is configured to seal an upper end of the junction annulus.

4. The system of claim 3, wherein the orienting liner hanger is configured to seal a lower end of the junction annulus, wherein the fluid separator assembly is configured to output the formation water into the junction annulus, and wherein the junction annulus is in fluid communication with the lateral bore such that the formation water is configured to flow into the lateral bore via the junction annulus.

5. The system of claim 1, wherein the fluid separator assembly includes an inlet feature configured to seal against an inner surface of the of the orienting liner hanger, wherein the inlet feature extends outward from an axially downhole end of the separator assembly, wherein the inlet feature includes a tubular and at least one seal disposed about the tubular, and wherein the seals are configured to seal the tubular against an inner surface of the of the orienting liner hanger with the tubular disposed in the orienting liner hanger.

6. The system of claim 1, wherein the lower completion includes: a lower production tubing, at least one production packer configured to isolate production zones along the lower production tubing, and at least one screen disposed in each production zone, and wherein formation fluid is configured to enter the lower production tubing via the at least one screen and flow uphole toward the fluid separator assembly.

7. The system of claim 1, wherein the fluid separator assembly comprises:

an assembly housing;

a fluid separator disposed within the assembly housing, wherein the fluid separator is configured to at least partially separate oil of the formation fluid from water of the formation fluid to at least partially separate the formation fluid into the formation oil and the formation water; and a pump disposed within the assembly housing in a position uphole from the fluid separator, wherein the pump is configured to drive the formation water into a lateral wellbore.

8. The system of claim 7, wherein the pump comprises a retrievable electrical submersible pump.

9. The system of claim 7, wherein the fluid separator includes an elongated tubular disposed within the assembly housing, wherein the elongated tubular includes at least one oil outlet formed in a top portion of the elongated tubular proximate an upper end of the elongated tubular, wherein the elongated tubular includes at least one water outlet formed in a bottom portion of the elongated tubular proximate the upper end of the elongated tubular, and wherein gravity is configured to separate the oil from the water based on density as the formation fluid flows in an uphole direction through the elongated tubular toward the oil outlet and the water outlet.

10. The system of claim 9, wherein the fluid separator assembly further comprises a fluid conduit extending from the at least one water outlet to a pump inlet of the pump, and wherein a water outlet line extends from a pump outlet of the pump to a housing water outlet formed in a radially outer surface of the assembly housing, and wherein the formation water is configured to flow toward the lateral bore via the housing water outlet.

11. The system of claim 10, wherein the housing water outlet is disposed within the junction of the multilateral well.

12. The system of claim 10, wherein the fluid separator assembly includes a one way check valve disposed within the water outlet line, wherein the one way check valve is configured to prevent formation water from flowing into the fluid separator assembly from the junction annulus and/or the lateral bore.

13. The system of claim 9, wherein the fluid separator assembly further comprises an oil flow path extending from the at least one oil outlet to a housing oil outlet formed in an upper end of the assembly housing, and wherein the formation oil is configured to flow into the upper production tubing via the housing oil outlet.

14. The system of claim 1, further comprising a controller and at least one pressure and/or temperature sensor positioned between the orienting liner hanger and an upper completion packer in the main bore, wherein the controller is configured to receive pressure and/or temperature measurements from the at least one pressure and/or temperature sensor, and wherein the controller is configured to output instructions to control a flow rate of a pump of the fluid separator assembly based at least in part on the pressure and/or temperature measurements.

15. The system of claim 1, further comprising an upper inflow control valve and a lower inflow control valve disposed between the fluid separator assembly and an upper completion packer, wherein the lower inflow control valve is configured to selectively block flow of formation oil through the upper production tubing, wherein the upper inflow control valve is disposed between the lower inflow control valve and the upper completion packer, and wherein the upper inflow control valve is configured to open a flow path from the junction annulus to the upper production tubing in response to the lower inflow control valve blocking flow of the formation oil through the upper production tubing such that the formation water may flow to the surface via the upper production tubing for sampling.

16. A system comprising:

an orienting liner hanger disposed in a main bore of a multilateral well in a position downhole from a junction of the multilateral well;

a lower completion secured to a downhole end of the orienting liner hanger;

a fluid separator assembly disposed at least partially within the junction of the multilateral well and uphole from the orienting liner hanger, wherein the fluid separator assembly is configured to receive formation fluid flowing uphole from the lower completion, wherein the formation fluid includes oil and water, wherein the fluid separator assembly is configured to at least partially separate the formation fluid into formation oil and formation water, wherein the fluid separator assembly is configured to output formation oil to an upper production tubing, and wherein the fluid separator assembly is configured to output the formation water into a lateral bore of the multilateral well; and an upper completion packer secured within the main bore in a position uphole from the fluid separator assembly, wherein the upper production tubing extends from the fluid separator assembly to the upper completion packer, wherein a junction annulus is formed in the main bore between a wellbore wall of the main bore and radially outer surfaces of the fluid separator assembly and the upper production tubing, wherein the junction annulus is in fluid communication with the lateral bore, and wherein the upper completion packer is configured to seal an upper end of the junction annulus and the orienting liner hanger is configured to seal a lower end of the junction annulus such that formation water output into the junction annulus, via the fluid separator assembly, is directed to flow into the lateral bore from the junction annulus.

17. A method, comprising:

drawing a formation fluid into a fluid separator assembly, wherein the formation fluid includes oil and water, wherein the fluid separator assembly is located at a junction of a multilateral well, wherein the fluid separator assembly is configured to receive formation fluid flowing uphole from a lower completion, wherein the lower completion is in fluid communication with a downhole end of an orienting liner hanger, wherein the orienting liner hanger is disposed in a main bore of the multilateral bore in a position downhole from the junction of the multilateral well, and wherein the fluid separator assembly is disposed uphole from the orienting liner hanger;

separating, at least partially, the formation fluid into formation oil and formation water via the fluid separator assembly;

drawing formation oil up hole to a surface via an upper production tubing, wherein the fluid separator assembly is configured to output the formation oil to the upper production tubing; and injecting formation water from the fluid separator assembly into a lateral bore of the multilateral well.

18. The method of claim 17, further comprising the step of cleaning the formation water before injecting the formation water into the lateral bore.

19. The method of claim 17, further comprising the step of measuring a pressure of the formation water in an annulus of the main bore of the multilateral well in between the fluid separator assembly and an upper completion packer.

20. The method of claim 17, further comprising the step of measuring temperature of the formation water in an annulus of the main bore of the multilateral well in between the fluid separator assembly and an upper completion packer.

* * * * *